US012618220B2

(12) United States Patent
Tang et al.

(10) Patent No.: US 12,618,220 B2
(45) Date of Patent: May 5, 2026

(54) OPERATION DEVICE OF SKID-STEER LOADER, AND SKID-STEER LOADER

(71) Applicants: ZOOMLION HEAVY INDUSTRY SCIENCE AND TECHNOLOGY CO., LTD., Changsha (CN); ZOOMLION SHAANXI WESTERN EARTHMOVING MACHINERY CO., LTD, Weinan (CN); ZOOMLION EARTHMOVING MACHINERY CO., LTD., Changsha (CN)

(72) Inventors: Xiong Tang, Changsha (CN); Qianyou Kuang, Changsha (CN); Guorui Qu, Changsha (CN); Bin Bian, Changsha (CN); Qian Li, Changsha (CN)

(73) Assignees: ZOOMLION HEAVY INDUSTRY SCIENCE AND TECHNOLOGY CO., LTD., Changsha (CN); ZOOMLION SHAANXI WESTERN EARTHMOVING MACHINERY CO., LTD, Weinan (CN); ZOOMLION EARTHMOVING MACHINERY CO., LTD., Changsha (CN)

( * ) Notice: Subject to any disclaimer, the term of this patent is extended or adjusted under 35 U.S.C. 154(b) by 483 days.

(21) Appl. No.: 18/032,904

(22) PCT Filed: Dec. 17, 2020

(86) PCT No.: PCT/CN2020/137127

§ 371 (c)(1),
(2) Date: Sep. 13, 2023

(87) PCT Pub. No.: WO2022/082978

PCT Pub. Date: Apr. 28, 2022

(65) Prior Publication Data

US 2024/0003116 A1 Jan. 4, 2024

(30) Foreign Application Priority Data

Oct. 20, 2020 (CN) ..... 202011126549.7

(51) Int. Cl.
*E02F 3/42* (2006.01)
*E02F 3/34* (2006.01)

(52) U.S. Cl.
CPC ..... *E02F 3/3414* (2013.01); *E02F 3/422* (2013.01)

(58) Field of Classification Search
CPC ..... E03F 3/34; E03F 3/3414; E02F 9/2275; Y10S 414/131
(Continued)

(56) References Cited

U.S. PATENT DOCUMENTS 6,171,050 B1 1/2001 Johnson
9,045,882 B2 * 6/2015 Major ..... E02F 3/283
(Continued)

FOREIGN PATENT DOCUMENTS

CN 2687076 Y 3/2005
CN 102817384 A 12/2012
(Continued)

*Primary Examiner* — Ronald P Jarrett
(74) *Attorney, Agent, or Firm* — Volpe Koenig

(57) ABSTRACT

The present invention relates to construction machinery, and relates in particular to an operation device of a skid-steer loader, and a skid-steer loader. The operation device of a skid-steer loader can be disposed on a frame structure (3) of the skid-steer loader, and is located on a side of an operator cab (5) of the skid-steer loader. The operation device comprises a lift arm (16) comprising a clearance section (10). When the lift arm (16) is in a traveling position, the clearance section (10) is located in a region of the lift arm (16) adjacent to a side window of the operator cab. A top portion of the clearance section (10) is recessed toward a bottom portion of the frame structure (3) of the skid-steer
(Continued)

loader. The operation device of the skid-steer loader can reduce the area on the side of the operator cab blocked by the lift arm, thereby increasing the peripheral vision of a driver.

11 Claims, 4 Drawing Sheets

(58) Field of Classification Search
USPC ..... 414/685, 686, 722, 918
See application file for complete search history.

(56) References Cited

U.S. PATENT DOCUMENTS

| | | | | |
|---|---|---|---|---|
| 2008/0267754 | A1* | 10/2008 | Yamada | E02F 3/3405 414/685 |
| 2015/0132095 | A1* | 5/2015 | Takemura | E02F 9/2275 414/722 |
| 2016/0024748 | A1* | 1/2016 | Ito | E02F 3/422 414/685 |
| 2018/0106011 | A1* | 4/2018 | Kumbhar | E02F 3/3414 |

FOREIGN PATENT DOCUMENTS

| | | | |
|---|---|---|---|
| CN | 103195117 | A | 7/2013 |
| CN | 108678044 | A | 10/2018 |
| CN | 208346879 | U | 1/2019 |
| CN | 111719611 | A | 9/2020 |

* cited by examiner

OPERATION DEVICE OF SKID-STEER LOADER, AND SKID-STEER LOADER

CROSS REFERENCE TO RELATED APPLICATIONS

This application is a 35 USC § 371 National Stage application of International Patent Application No. PCT/CN2020/137127, which was filed Dec. 17, 2020, entitled "OPERATION DEVICE OF SKID-STEER LOADER, AND SKID-STEER LOADER" and claims priority to Chinese Patent Application No. 202011126549.7 filed on Oct. 20, 2020, which are incorporated herein by reference as if fully set forth.

FIELD

The present invention relates to construction machinery, in particular to an operation device of a skid-steer loader and a skid-steer loader.

BACKGROUND

A skid-steer loader is a small-size construction machine that is compact and highly maneuverable. The operation device of a skid-steer loader is the main load-bearing structural component of the skid-steer loader, and the structural form of the operation device determines the field of view of the driver, and has great influences on the unloading height and the unloading range of the skid-steer loader. The main body of each lift arm is generally a rectangular tube, and the section of the lift arm near the side window of the operator cab is configured into the form of an inclined linear section, where the lift arm is at a higher position, and blocks a large area of the side window, resulting in a poor lateral field of view of the driver.

SUMMARY

The object of the present invention is to provide an operation device of a skid-steer loader and a skid-steer loader. The operation device of a skid-steer loader can reduce the blocking of the lift arm to the side of the operator cab and improve the lateral field of view of the driver.

To attain the above object, in a first aspect, the present invention provides an operation device of a skid-steer loader, which can be arranged on a frame structure of the skid-steer loader and is located at sides of a operator cab of the skid-steer loader, wherein the operation device comprises a lift arm comprising an clearance section, and when the lift arm is in a traveling position, the clearance section is located in a region of the lift arm adjacent to a side window of the operator cab, and a top portion of the clearance section is recessed toward a bottom portion of the frame structure of the skid-steer loader.

Preferably, the lift arm further comprises a first section and a second section, wherein the first section, the clearance section and the second section are arranged sequentially in a length direction of the lift arm.

Preferably, the top surface of the clearance section is an arc-shaped surface; and/or the top surface of the first section is a flat surface.

Preferably, the rear end of the clearance section extends to the rear end of the operator cab, and the front end of the clearance section extends to the front part of a driver's seat in the operator cab, when the lift arm is in the traveling position.

Preferably, when the lift arm is in the traveling position, with a reference length set to 1 and an index point of the driver's seat denoted as point G, the horizontal distance L1 between a rear end point K of the first section and the point G satisfies $0.8 \le L1 \le 1.2$, and the vertical distance L2 between the point K and the point G satisfies $0.611 \le L2 \le 0.916$; the horizontal distance L3 between a rear end point B of the clearance section and the point G satisfies $0.472 \le L3 \le 0.709$, and the vertical distance L4 between the point B and the point G satisfies $0.374 \le L4 \le 0.562$; and the horizontal distance L5 between the point G and a front end point C of the clearance section satisfies $0.146 \le L5 \le 0.219$, and the vertical distance L6 between the point G and the point C satisfies $0.09 \le L6 \le 0.136$.

Preferably, the operation device comprises driving mechanisms configured to drive the lift arm to switch between a traveling position and a lifting position.

Preferably, the driving mechanism comprises a lift cylinder which has a cylinder tube fixedly arranged on the frame structure and a telescopic rod extending into a chamber of the corresponding lift arm and hinged to the lift arm.

Preferably, the operation device comprises safety supporting members for wrapping around the extended telescopic rods to prevent the telescopic rod from retracting in an abnormal state, and the lift arm has a mounting part for mounting a corresponding safety supporting member.

Preferably, the mounting part comprises a mounting plate arranged on the middle part of the lift arm and a wedge plate arranged on the front part of the lift arm, the mounting plate has a first pin hole, the safety supporting member comprises a strip-shaped housing having a strip-shaped opening, and a connecting plate arranged on a first end of the strip-shaped housing, the first end has a socket for receiving the mounting plate, the connecting plate has a second pin hole corresponding to the first pin hole in the mounting plate inserted in the socket, the first end is connected to the mounting plate via a bolt inserted in the first pin hole and the second pin hole, and the wedge plate is configured to be wedged in an opening of a second end of the strip-shaped housing.

Preferably, the front part and the rear part of the lift arm are provided with a hole for a hydraulic pipeline to pass through respectively, and the hydraulic pipeline passes through the chamber of a corresponding lift arm via the hole.

Preferably, a pipe clamp seat for fixing the hydraulic pipeline is provided at the hole in the rear part of the lift arm, and/or a fixing plate for fixing a hydraulic joint is provided at the hole in the front part of the lift arm.

Preferably, the operation device comprises a pair of lift arms arranged at the left side and right side of the operator cab, and the rear ends of the pair of lift arms are connected via a connecting rod.

Preferably, the operation device comprises a first rocker and a second rocker, which are hinged to the lift arms respectively at one end, and are hinged to the frame structure respectively at the other end.

In a second aspect, the present invention provides a skid-steer loader, which comprises a frame structure, a operator cab arranged on the frame structure, and the operation device for a skid-steer loader as described above.

With the above technical scheme, by configuring the top surface of the middle part of each lift arm corresponding to a side window of the operator cab into the form of a recessed concave surface, the height of the middle part of the lift arm corresponding to the side window of the operator cab can be decreased, the area of the side of the operator cab blocked by the lift arm can be reduced, and the lateral field of view of the driver can be improved.

Other features and advantages of the present invention will be further detailed in the following embodiments.

BRIEF DESCRIPTION OF THE DRAWINGS

The accompanying drawings are provided herein to facilitate further understanding on the present invention and constitute a part of this document. They are used in conjunction with the following embodiments to explain the present invention, but are not intended to constitute any limitation to the present invention. In the figures.

REFERENCE NUMBERS

Figure 1:
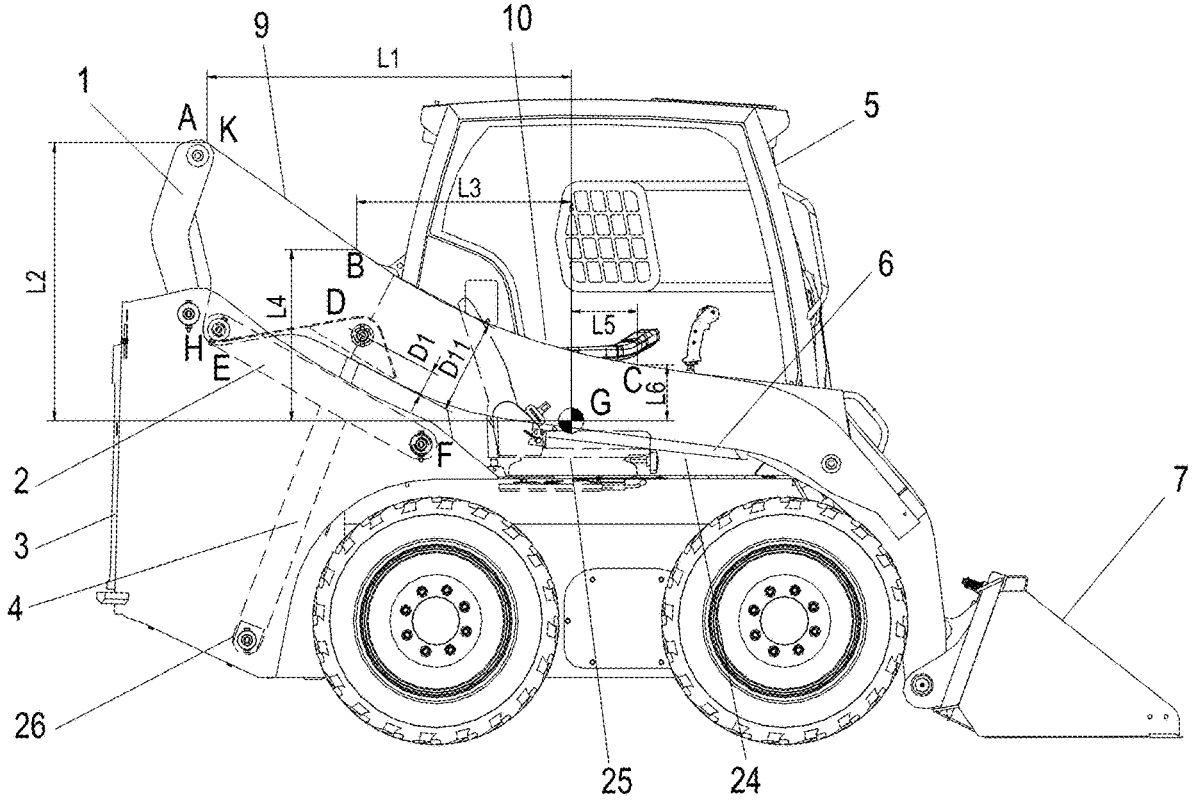
FIG. 1 is a schematic structural diagram of an embodiment of the skid-steer loader in the present invention.

1. first rocker; 2. second rocker; 3. frame structure; 4. lift cylinder; 5. operator cab; 6. safety supporting member; 7. bucket; 8. connecting rod; 9. first section; 10. clearance section; 11. second section; 12. hydraulic pipeline; 13. pipe clamp seat; 14. hydraulic joint; 15. handrail; 16. lift arm; 17. mounting plate; 18. wedge plate; 19. bolt; 20. fixing plate; 21. connecting plate; 22. cylinder tube; 23. telescopic rod; 24. front of a driver's seat; 25. driver's seat; 26. driving mechanism.

DETAILED DESCRIPTION OF EMBODIMENTS

Some embodiments of the present invention will be detailed below with reference to the accompanying drawings. It should be understood that the embodiments described herein are only provided to describe and explain the present invention, but are not intended to constitute any limitation to the present invention.

In the present invention, unless contrarily specified, the orientational terms "front" and "rear" are usually used with reference to the orientation of the skid-steer loader when the skid-steer loader travels, while the orientational terms "top" and "top surface" are used reference to the orientation of the skid-steer loader when the skid-steer loader is in a horizontal position and the lift cylinder 4 are retracted to a minimum stroke.

In a first aspect, the present invention provides an operation device of a skid-steer loader, which can be arranged on a frame structure 3 of the skid-steer loader and is located at sides of a operator cab 5 of the skid-steer loader, wherein the operation device comprises a lift arm 16 comprising an clearance section 10, and when the lift arm 16 is in a traveling position, the clearance section 10 is located in a region of the lift arm 16 adjacent to a side window of the operator cab, and a top portion of the clearance section 10 is recessed toward a bottom portion of the frame structure 3 of the skid-steer loader. The clearance section 10 corresponds to a side window of the operator cab 5. The lift arms 16 are usually inclined downward from front to rear when they are in a traveling position (the lift arms are usually lowered to the lowest position when the skid-steer loader travels, therefore the traveling position refers to the lowest position of the lift arms), the height of the front part of the lift arm 16 is relatively low and the front part does not affect the lateral field of view of the driver; the height of the rear part of the lift arm 16 is relatively high, but the rear part also doesn't affect the lateral field of view of the driver since it is behind the operator cab 5; therefore, the height of the front part and the height of the rear part of the lift arm 16 may be kept unchanged. The height of the middle part is between the height of the rear part and the height of the front part, and the middle part of the lift arm 16 may easily affect the lateral field of view of the driver. Therefore, the top surface of the middle part is configured into the form of a downwardly recessed surface.

With the above technical scheme, by configuring the top surface of the middle part of each lift arm 16 corresponding to a side window of the operator cab 5 into the form of a recessed concave surface, the height of the middle part of the lift arm 16 corresponding to the side window of the operator cab 5 can be decreased, the area of the side of the operator cab 5 blocked by the lift arm 16 can be reduced, and the lateral field of view of the driver can be improved.

Figure 2:
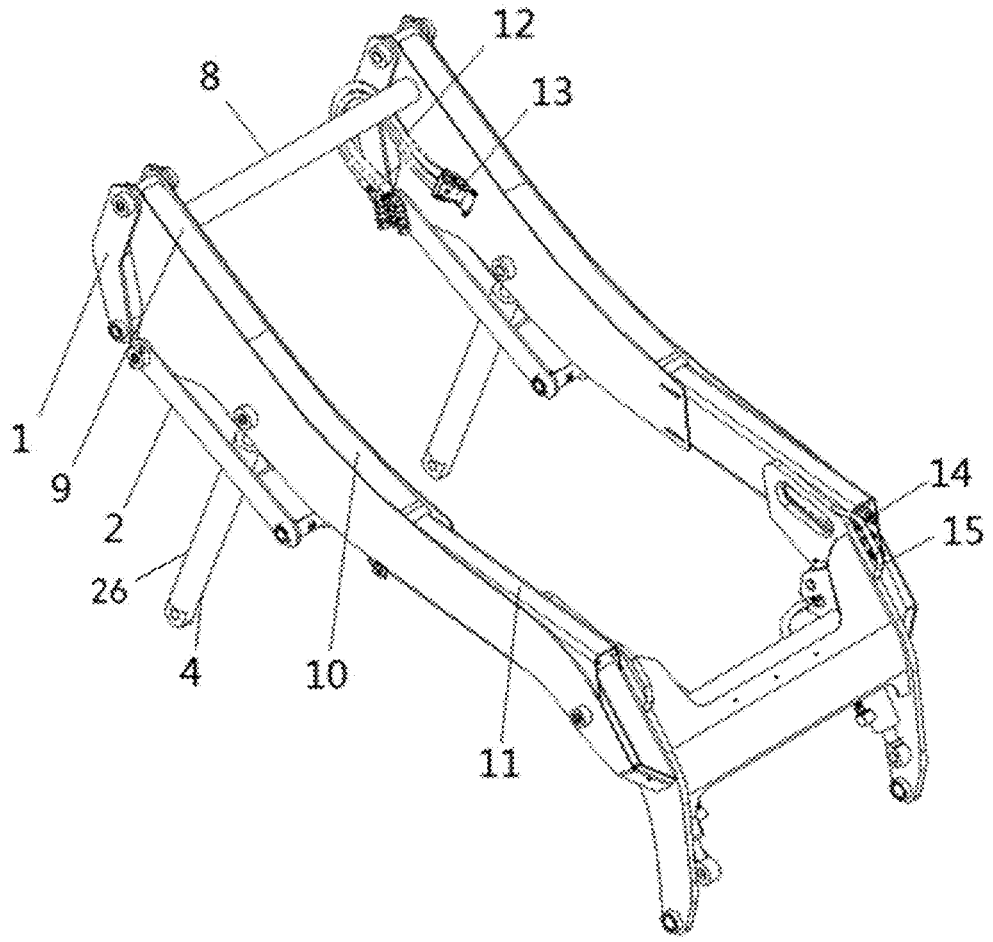
FIG. 2 is a schematic structural diagram of an embodiment of the operation device of a skid-steer loader in the present invention.

As an embodiment, as shown in FIG. 2, the lift arm 16 further comprises a first section 9 and a second section 11, wherein the first section 9, the clearance section 10 and the second section 11 are arranged sequentially in a length direction of the lift arm 16. That is to say, the clearance section 10 is at the middle part of the lift arm 16 in the length direction. As shown in FIG. 1, the section between the point K and the point B is the first section 9, the section between the point B and the point C is the clearance section 10, and the section from the point C to the front end of the lift arm 16 is the second section 11, and the front end of the second section 11, i.e., the end of the second section 11 away from the clearance section 10, is connected to the bucket 7 of the skid-steer loader.

As an embodiment, as shown in FIGS. 1-2, the top surface of the middle part of the lift arm is configured into the form of a downwardly recessed concave surface, and may be arc-shaped integrally or partially, and the recessed shape may be formed integrally, formed by welding, or formed by assembling.

As an embodiment, as shown in FIGS. 1-2, the top surface of the clearance section 10 is an arc-shaped surface. Optionally, the bottom surface of the clearance section 10 is an arc-shaped convex surface, i.e., the clearance section 10 is bent downward entirely, so as to reduce the height of the clearance section 10 in the traveling position and ensure the rigidity of the clearance section 10.

As an embodiment, as shown in FIG. 2, the top surface of the first section 9 is a flat surface. That is to say, the top surface between the point K and the point C (the first section 9 and the clearance section 10) is changed from the original entirely linear form to a form of a linear section plus an arc-shaped section, so as to reduce the height of the top surface of the section BC and improve the lateral field of view of the operator cab 5. In view that a linear section can be manufactured more easily, the top surface of the first section 9 is configured into the form of a flat surface to facilitate manufacturing, on the premise that there is no adverse effect on the lateral field of view of the operator cab 5.

As an alternative embodiment, the top surface of the first section 9 may be configured into a concave surface, specifically an arc-shaped concave face, or the top surfaces of the first section 9 and the clearance section 10 may be configured integrally into a concave surface that is in an arc shape or other shape, such as broken line plus broken line, or broken line plus arc shape, etc.

As an embodiment, as shown in FIG. 1, the rear end of the clearance section 10 extends to the rear end of the operator cab 5, and the front end of the clearance section 10 extends to the front part of a driver's seat in the operator cab 5, when the lift arm 16 is in the traveling position. That is to say, when the lifts arm is in the traveling position, the first section 9 is located behind the operator cab, one part of the second section 11 corresponds to a side window of the operator cab, and the other part of the second section 11 is in front of the operator cab. Since the height of the second section 11 is low and the second section 11 does not affect the lateral field of view of the driver, it is unnecessary to change the part corresponding to the side window of the operator cab; instead, only the height of the middle part (the clearance section 10) that is relatively high and affects the lateral field of view of the driver has to be changed.

As an embodiment, as shown in FIG. 1, when the lift arm 16 is in the traveling position, with a reference length set to 1 and an index point of the driver's seat (SIP) denoted as point G, the horizontal distance L1 between a rear end point K of the first section 9 and the point G satisfies $0.8 \leq L1 \leq 1.2$, and the vertical distance L2 between the point K and the point G satisfies $0.611 \leq L2 \leq 0.916$; the horizontal distance L3 between a rear end point B of the clearance section 10 and the point G satisfies $0.472 \leq L3 \leq 0.709$, and the vertical distance L4 between the point B and the point G satisfies $0.374 \leq L4 \leq 0.562$; and the horizontal distance L5 between the point G and a front end point C of the clearance section 10 satisfies $\leq L5 \leq 0.219$, and the vertical distance L6 between the point G and the point C satisfies $0.09 \leq L6 \leq 0.136$. By arranging the lift arm 16 according to the above conditions, the lateral field of view of the driver can be further improved.

As an embodiment, the operation device comprises driving mechanism 26 configured to drive the lift arm 16 to switch between a traveling position and a lifting position.

As an embodiment, as shown in FIGS. 1-2, the driving mechanism 26 comprises a lift cylinder 4, which has a cylinder tube 22 fixedly arranged on the frame structure 3 and a telescopic rod 23 extending into a chamber of the corresponding lift arm 16 and hinged to the lift arm 16. As shown in FIG. 1, the lift arm 16 is hinged to the telescopic rod 23 of the lift cylinder 4 at a point D, which is inside the chamber of the lift arm 16. Such a design solves the problem of an inadequate stroke of the lift cylinder 4 incurred by the downward bending of the lift arm 16, ensures the unloading height of the machine, and increases the stroke of the lift cylinder 4. The traveling position refers to the position of the lift arm 16 when the piston rod of the lift cylinder 4 does not extend. The lifting position refers to the position of the lift arm 16 when the piston rod of the lift cylinder 4 extends and jacks up the lift arm 16. The lifting position comprises the highest position of the lift arm 16 and a position of the lift arm 16 between the highest position and the traveling position.

Preferably, the length D1 from the hinge point D to the bottom of the lift arm 16 is 20%-40% of the cross-sectional length D11 of the lift arm 16 at the hinge point D.

As an embodiment, the operation device comprises safety supporting members 6 for wrapping around the extended telescopic rod 23 to prevent the telescopic rod 23 from retracting in an abnormal state, and the lift arm 16 has a mounting part for mounting a corresponding safety supporting member 6.

Figure 5:
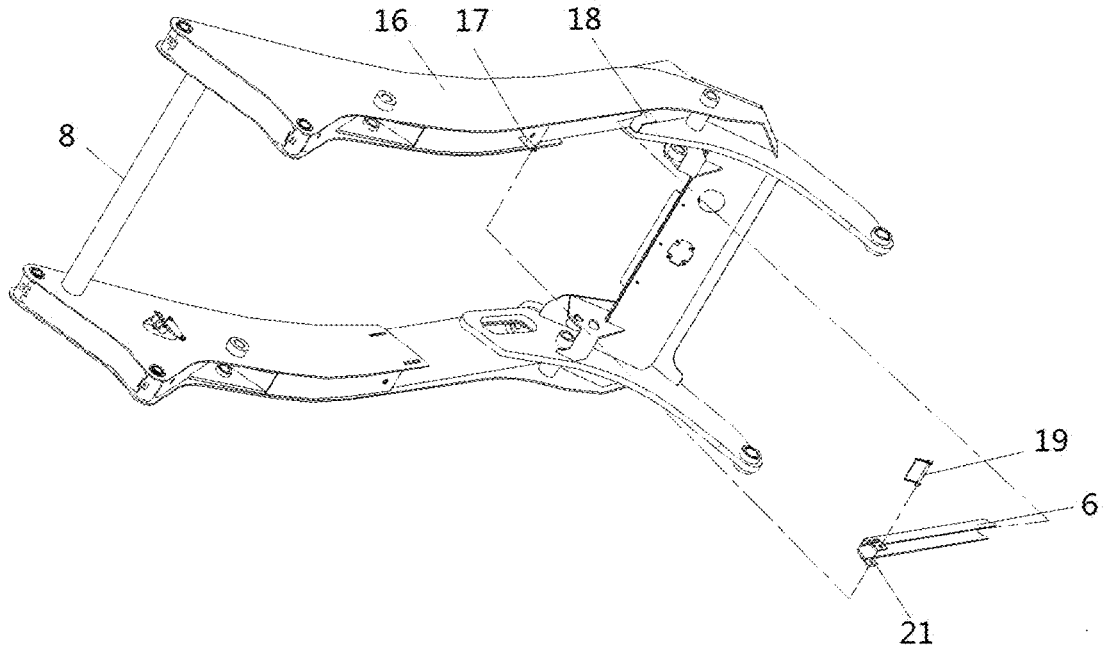
FIG. 5 is a schematic structural diagram of the safety supporting member of the operation device of a skid-steer loader in the present invention before the safety supporting member is mounted on the lift arm.
Figure 6:
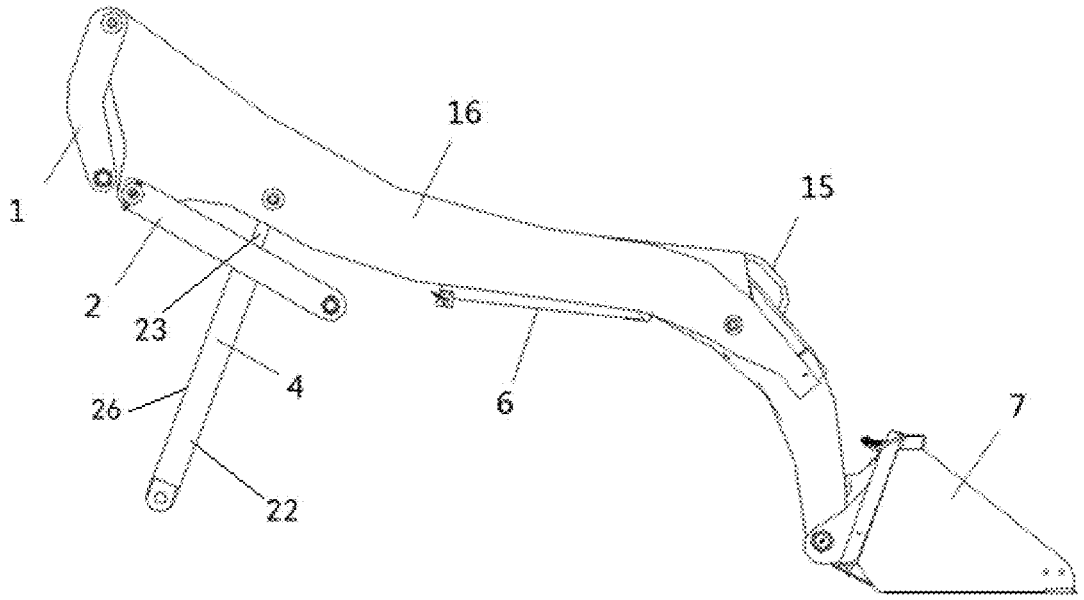
FIG. 6 is a schematic structural diagram of an embodiment of the connection between the operation device of a skid-steer loader and a bucket in the present invention.

As an embodiment, as shown in FIGS. 1, 5 and 6, the mounting part comprises a mounting plate 17 arranged on the middle part of the lift arm 16 and a wedge plate 18 arranged on the front part of the lift arm 16, the mounting plate 17 has a first pin hole, the safety supporting member 6 comprises a strip-shaped housing having a strip-shaped opening, and a connecting plate 21 arranged on a first end of the strip-shaped housing, the first end has a socket for receiving the mounting plate 17, the connecting plate 21 has a second pin hole corresponding to the first pin hole in the mounting plate 17 inserted in the socket, the first end is connected to the mounting plate 17 via a bolt 19 inserted in the first pin hole and the second pin hole, and the wedge plate 18 is configured to be wedged in an opening of a second end of the strip-shaped housing. Optionally, the cross section of the strip-shaped housing is U-shaped; a pair of connecting plates 21 is provided opposite to each other, and each of the connecting plates 21 has the second pin hole respectively. As shown in FIGS. 1 and 6, when the safety supporting member 6 does not have to support the telescopic rod, the safety supporting member 6 may be mounted on a mounting part, the wedge plate 18 is wedged into the opening of the second end of the safety supporting member 6, and the mounting plate 17 is inserted into the socket of the first end of the safety supporting member 6, then the bolt 19 is inserted into the first pin hole and the two second pin holes, so as to fix the safety supporting member 6 to the lift arm 16, thereby the problem that it is inconvenient to mount the safety supporting member 6 owing to the downward bending of the lift arm 16 is solved. To use the safety supporting member 6, the safety supporting member 6 may be wrapped outside the extended telescopic rod of the lift cylinder 4, the bolt 19 may be inserted into the pair of second pin holes to prevent the safety supporting member 6 from disengaging from the telescopic rod, the top end of the safety supporting member 6 may abut against the lift arm 16, and the bottom end of the safety supporting member 6 may abut against the cylinder tube 22 of the lift cylinder 4. Such a design avoids a phenomenon that the telescopic rod drives the lift arm to retract in an abnormal state, and improves reliability.

As an embodiment, the front part and the rear part of the lift arm 16 are provided with a hole for a hydraulic pipeline 12 to pass through respectively, and the hydraulic pipeline 12 passes through the chamber of a corresponding lift arm 16 via the hole. The hydraulic pipeline 12 can enter the chamber of the lift arm 16 and reach the front part of the lift arm 16 via the hole in the rear part of the lift arm 16, and can extend out of the chamber of the lift arm 16 via the hole in the front part of the lift arm 16, so that it can be connected to an oil cylinder on the front part conveniently. Such a design can protect the hydraulic pipeline 12 well, and avoid a situation that the hydraulic pipeline 12 and the operator cab 5 may chafe each other owing to very small clearance between them in a case that the hydraulic pipeline 12 is mounted outside the lift arm 16.

As an embodiment, as shown in FIG. 2, a pipe clamp seat 13 for fixing the hydraulic pipeline 12 is provided at the hole in the rear part of the lift arm 16, to facilitate the fixing of the hydraulic pipeline 12.

Figure 4:
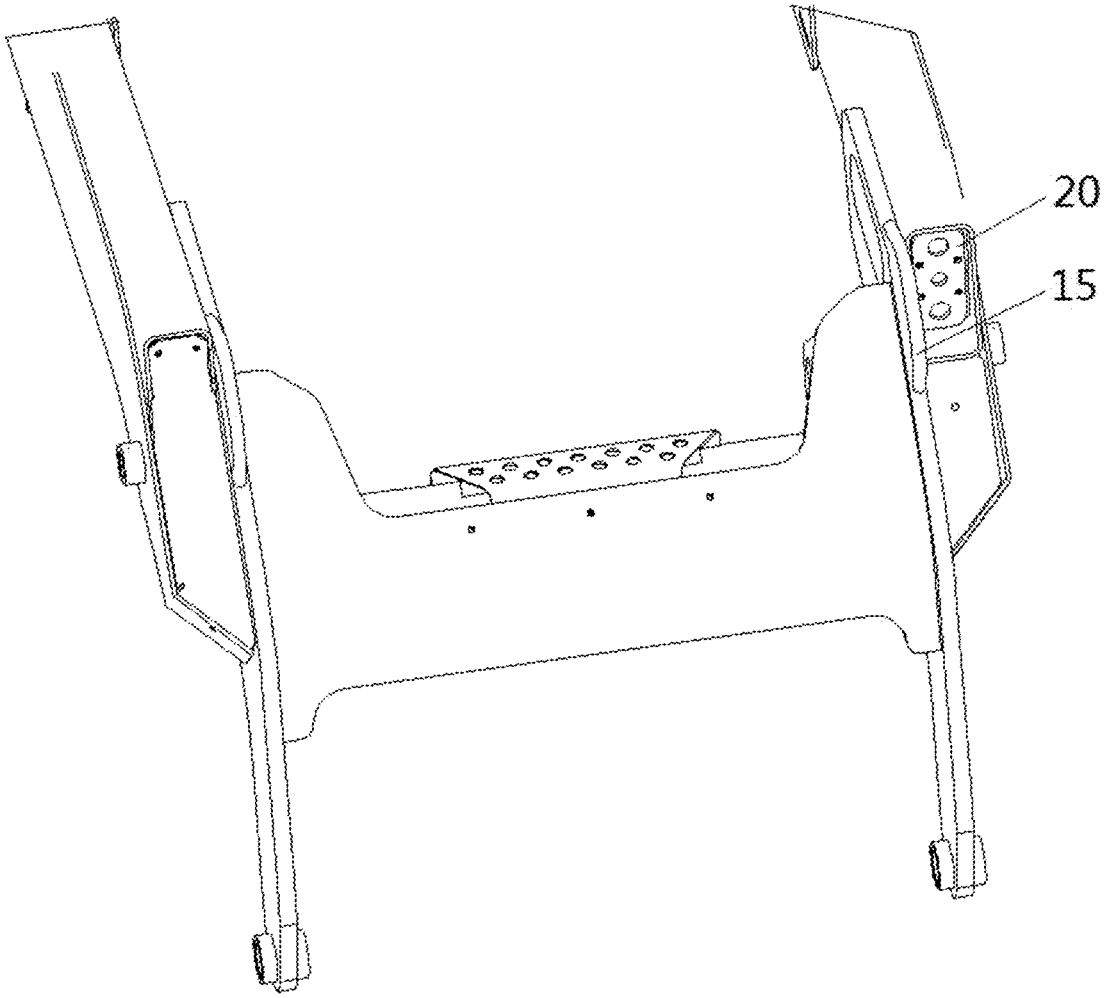
FIG. 4 is another partial schematic structural diagram of the operation device of a skid-steer loader shown in FIG. 2.

As an embodiment, as shown in FIG. 4, a fixing plate 20 for fixing the hydraulic joint 14 is provided at the hole in the front part of the lift arm 16 to facilitate mounting.

As an embodiment, as shown in FIGS. 1-4 and 6, a handrail 15 is provided on the front part of the lift arm 16 near the hydraulic joint 14. In such a design, the handrail 15 can protect the hydraulic joint 14 against impact and damage while serving as a handrail 15.

Figure 3:
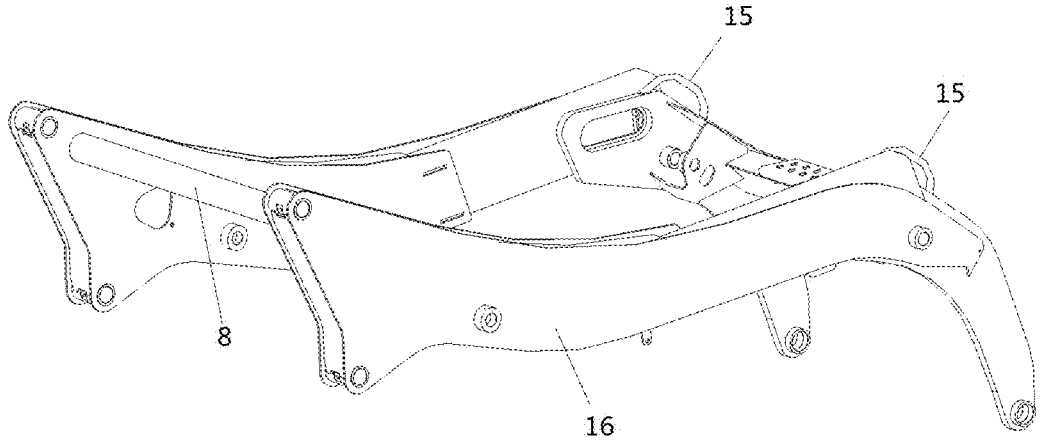
FIG. 3 is a partial schematic structural diagram of the operation device of a skid-steer loader shown in FIG. 2.

As an embodiment, as shown in FIGS. 2, 3 and 5, the operation device comprises a pair of lift arms 16 arranged on the left side and right side of the operator cab 5, and the rear ends of the pair of lift arms 16 are connected via a connecting rod 8. With the design of the connecting rod 8, the rigidity of the lift arms 16 can be improved, and the structure of the lift arms 16 is more stable.

As an embodiment, as shown in FIGS. 1, 2 and 6, the operation device comprises a first rocker 1 and a second rocker 2, which are hinged to the lift arms 16 respectively at one end, and are hinged to the frame structure 3 respectively at the other end. As shown in FIG. 1, the hinge point of the first rocker 1 to the lift arm 16 is a point A, and the hinge point of the first rocker 1 to the frame structure 3 is a point H; the hinge point of the second rocker 2 to the lift arm 16 is a point E, and the hinge point of the second rocker 2 to the frame structure 3 is a point F.

As an embodiment, as shown in FIG. 1, the lift arms are inclined downward toward the front side of the operator cab 5 from the rear side of the operator cab 5 when they are in the traveling position.

In a second aspect, the present invention provides a skid-steer loader. As shown in FIG. 1, the skid-steer loader comprises a frame structure 3, an operator cab 5 arranged on the frame structure 3, and the operation device for a skid-steer loader as described above.

The operation device can improve the lateral field of view of the driver, optimizes the hinge positions of the lift cylinder 4 to the lift arms 16, and ensure the unloading height of the machine; since the hydraulic pipelines 12 on the operation device are mounted in a manner that they pass through the chambers of the lift arms 6, the hydraulic pipelines 12 and the hydraulic joints 14 are protected well; the connecting rod 8 reinforces the lift arms 16; and the safety supporting members can be mounted on the lift arms 16 in an inventive manner, thereby the problem that it is inconvenient to mount the safety supporting members owing to the downward bending of the lift arms 16 is solved.

While some preferred embodiments of the present invention are described above with reference to the accompanying drawings, the present invention is not limited to the details in those embodiments. Those skilled in the art can make various simple modifications and variations to the technical scheme of the present invention, without departing from the technical concept of the present invention. However, all these simple modifications and variations shall be deemed as falling in the scope of protection of the present invention. For example, the driving mechanism may be an air cylinder.

In addition, it should be noted that the specific technical features described in the above embodiments may be combined in any appropriate form, provided that there is no conflict among them. To avoid unnecessary repetition, various possible combinations are not described specifically in the present invention.

Moreover, different embodiments of the present invention may also be combined freely as required, as long as the combinations do not deviate from the ideal of the present invention. However, such combinations shall also be deemed as being disclosed in the present invention.

The invention claimed is:

1. An operation device of a skid-steer loader, which can be arranged on a frame structure of the skid-steer loader and located at sides of an operator cab of the skid-steer loader, comprising:

a lift arm having a clearance section, a first section, and a second section, and the first section, the clearance section, and the second section are arranged sequentially in a length direction of the lift arm, wherein when the lift arm is in a traveling position, the clearance section is located in a region of the lift arm adjacent to a side window of the operator cab, and a top portion of the clearance section is recessed toward a bottom portion of the frame structure of the skid-steer loader, wherein when the lift arm is in the traveling position, with a reference length set to 1 and an index point of a driver's seat in the operator cab denoted as point G, a horizontal distance L1 between a rear end point K of the first section and the point G satisfies $0.8 \leq L1 \leq 1.2$, and a vertical distance L2 between the point K and the point G satisfies $0.611 \leq L2 \leq 0.916$;

a horizontal distance L3 between a rear end point B of the clearance section and the point G satisfies $0.472 \leq L3 \leq 0.709$, and a vertical distance L4 between the point B and the point G satisfies $0.374 \leq L4 \leq 0.562$; and a horizontal distance L5 between the point G and a front end point C of the clearance section satisfies $0.146 \leq L5 \leq 0.219$, and a vertical distance L6 between the point G and the point C satisfies $0.09 \leq L6 \leq 0.136$.

2. The operation device of a skid-steer loader of claim 1, wherein a top surface of the clearance section is an arc-shaped surface; and/or a top surface of the first section is a flat surface.

3. The operation device of a skid-steer loader of claim 1, wherein a top surface of the first section is a concave surface; and/or a top surface of the first section and a top surface of the clearance section are configured to be arc-shaped concave surfaces integrally.

4. The operation device of a skid-steer loader of claim 1, wherein the rear end of the clearance section extends to the rear end of the operator cab, and the front end of the clearance section extends to a front of the driver's seat, when the lift arm is in the traveling position.

5. The operation device of a skid-steer loader of claim 1, further comprises a driving mechanism operatively connected with the lift arm for switching the lift arm between the traveling position and a lifting position.

6. The operation device of a skid-steer loader of claim 5, wherein the driving mechanism comprises a lift cylinder, which has a cylinder tube fixedly arranged on the frame structure and a telescopic rod extending into a chamber of the corresponding lift arm and hinged to the lift arm.

7. The operation device of a skid-steer loader of claim 6, further comprises safety supporting members wrapped around the extended telescopic rod to prevent the telescopic rod from retracting inadequately when switching between the traveling position and the lifting position, and the lift arm has a mounting part for mounting a corresponding safety supporting member.

8. The operation device of a skid-steer loader of claim 7, wherein the mounting part comprises a mounting plate arranged on a middle part of the lift arm and a wedge plate arranged on a front part of the lift arm, the mounting plate has a first pin hole, each of the safety supporting members comprise a strip-shaped housing having a strip-shaped opening, and a connecting plate arranged on a first end of the strip-shaped housing, the first end has a socket for receiving the mounting plate, the connecting plate has a second pin hole corresponding to the first pin hole in the mounting plate inserted in the socket, the first end is connected to the mounting plate via a bolt inserted in the first pin hole and the second pin hole, and the wedge plate is configured to be wedged in an opening of a second end of the strip-shaped housing.

9. The operation device of a skid-steer loader of claim 1, wherein a front part and a rear part of the lift arm are provided with a hole for a hydraulic pipeline to pass through respectively, and the hydraulic pipeline passes through the chamber of a corresponding lift arm via the hole.

10. The operation device of a skid-steer loader of claim 9, wherein a pipe clamp seat for fixing the hydraulic pipeline is provided at the hole in the rear part of the lift arm, and/or a fixing plate for fixing a hydraulic joint is provided at the hole in the front part of the lift arm.

11. A skid-steer loader, comprising:

a frame structure;

an operator cab arranged on the frame structure; and an operation device, arranged on the frame structure and located at sides of the operator cab, including a lift arm having a clearance section, a first section, and a second section, and the first section, the clearance section, and the second section are arranged sequentially in a length direction of the lift arm, wherein when the lift arm is in a traveling position, the clearance section is located in a region of the lift arm adjacent to a side window of the operator cab, and a top portion of the clearance section is recessed toward a bottom portion of the frame structure of the skid-steer loader, wherein when the lift arm is in the traveling position, with a reference length set to 1 and an index point of a driver's seat in the operator cab denoted as point G, a horizontal distance L1 between a rear end point K of the first section and the point G satisfies $0.8 \leq L1 \leq 1.2$, and a vertical distance L2 between the point K and the point G satisfies $0.611 \leq L2 \leq 0.916$, a horizontal distance L3 between a rear end point B of the clearance section and the point G satisfies $0.472 \leq L3 \leq 0.709$, and a vertical distance L4 between the point B and the point G satisfies $0.374 \leq L4 \leq 0.562$, and a horizontal distance L5 between the point G and a front end point C of the clearance section satisfies $0.146 \leq L5 \leq 0.219$, and a vertical distance L6 between the point G and the point C satisfies $0.09 \leq L6 \leq 0.136$.

* * * * *